US008984795B2

(12) United States Patent
Jung et al.

(10) Patent No.: US 8,984,795 B2
(45) Date of Patent: Mar. 24, 2015

(54) SMALL ARM DOT SIGHT DEVICE

(71) Applicant: In Jung, Bucheon-si (KR)

(72) Inventors: In Jung, Bucheon-si (KR); Bo Sun Jeung, Bucheon-si (KR); Dong Hee Lee, Seongnam-si (KR)

(73) Assignee: In Jung, Bucheon-Si (KR)

( * ) Notice: Subject to any disclaimer, the term of this patent is extended or adjusted under 35 U.S.C. 154(b) by 0 days.

(21) Appl. No.: 14/048,969

(22) Filed: Oct. 8, 2013

(65) Prior Publication Data

US 2014/0109456 A1 Apr. 24, 2014

(30) Foreign Application Priority Data

Oct. 9, 2012 (KR) ..... 10-2012-0112001

(51) Int. Cl.
*F41G 1/30* (2006.01)
*F41G 1/26* (2006.01)

(52) U.S. Cl.
CPC ..... *F41G 1/30* (2013.01)
USPC ..... 42/113; 42/137

(58) Field of Classification Search
CPC ..... F41G 1/26; F41G 1/30; F41G 1/345
USPC ..... 42/113, 131, 132, 137, 143
See application file for complete search history.

(56) References Cited

U.S. PATENT DOCUMENTS

| | | | | | |
|---|---|---|---|---|---|
| 2,596,522 | A * | 5/1952 | Bethke | 42/113 |
| 2,633,051 | A * | 3/1953 | Davis | 356/251 |
| 4,665,622 | A * | 5/1987 | Idan | 42/113 |
| 4,764,011 | A * | 8/1988 | Goldstein | 356/251 |
| 5,369,888 | A * | 12/1994 | Kay et al. | 42/113 |
| 5,815,936 | A * | 10/1998 | Sieczka et al. | 42/115 |
| 6,327,806 | B1 | 12/2001 | Paige | |
| 2006/0162226 | A1 * | 7/2006 | Tai | 42/132 |
| 2008/0216379 | A1 * | 9/2008 | Javorsky | 42/115 |
| 2010/0083554 | A1 * | 4/2010 | Elpedes et al. | 42/123 |
| 2010/0275495 | A1 * | 11/2010 | Jung et al. | 42/113 |
| 2011/0154713 | A1 * | 6/2011 | Jung et al. | 42/137 |
| 2014/0096431 | A1 * | 4/2014 | Tang | 42/132 |

* cited by examiner

*Primary Examiner* — Bret Hayes
(74) *Attorney, Agent, or Firm* — Baker & McKenzie LLP

(57) ABSTRACT

A dot sight includes a base, a housing, a reflective element, an emitter, a horizontal adjusting portion and a vertical adjusting portion. The housing is coupled to the base. The reflective element is coupled to the housing. The emitter provides a reticle image to the reflective element. The reflective element reflects at least a portion of the reticle image. The emitter is coupled to the housing. The horizontal adjusting portion adjusts a position of the housing relative to the base. The vertical adjusting portion adjusts a position of the housing relative to the base.

20 Claims, 15 Drawing Sheets

Related Art (a)

SMALL ARM DOT SIGHT DEVICE

CROSS-REFERENCE TO RELATED APPLICATIONS

This application claims priority to Korean Application No. 2012-0112001, filed on Oct. 9, 2012, the contents of which is incorporated herein by reference in its entirety.

BACKGROUND

The present disclosure relates to a dot sight device for use in a small arm such as a handgun, a pistol, or a rifle, and more particularly, to a dot sight device for use in a small arm which is capable of aligning a principal ray among light rays from a dot reticle image of a dot sight device with a gun barrel of a small arm without causing a change in a relative position between a mask and a reflective mirror.

Small arms such as handguns, pistols, or rifles have a short distance of fire, and in order to increase an accuracy rate, a gun barrel needs to be aligned with an optical axis (an axis through which a principal ray among light rays from a dot reticle image passes) of a dot sight device. Here, a principal ray refers to a representative ray passing through the center of an effective portion of a reflective mirror of a dot sight device. For this reason, dot sight devices for small arms have increasingly employed a mechanism capable of aligning a gun barrel with an optical axis of a dot sight device.

An optical device with a mechanism that aligns a gun barrel of a handgun with an optical axis of an optical device by adjusting the position of a light emitting diode (LED) that provides a dot reticle is disclosed in U.S. Pat. No. 6,327,806. FIG. 1 is an exploded perspective view illustrating a dot sight device for used in a small arm with a mechanism disclosed in U.S. Pat. No. 6,327,806. Referring to FIG. 1, an elevation adjustment screw 17 used to move an LED with a reticle or a mask (hereinafter, "mask") fixed to the front thereof from a focal position of a reflective mirror 1 in the horizontal direction, and an azimuth adjustment screw 18 used to move the LED from the focal position of the reflective mirror 1 in the vertical direction are provided. A gun barrel is aligned with a dot reticle image that is reflected from the reflective mirror and then directed toward an observer by turning the elevation adjustment screw 17 or the azimuth adjustment screw 18 according to need.

However, in the mechanism disclosed in U.S. Pat. No. 6,327,806, since the relative position of the LED is adjusted in a state in which the reflective mirror 1 is fixed, the dot reticle provided from the LED is likely to deviate from the focal point of the reflective mirror 1 in the process of adjustment. Thus, there is a problem in that parallax between light rays which are reflected from the reflective mirror and then incident to the observer's eye(s) and a target viewed through the reflective mirror significantly occurs in the edge portion of the reflective mirror. In other words, since the relative position of the LED relative to the reflective mirror, that is, the relative position of the mask relative to the reflective mirror is changed, parallax of the dot sight device changes.

More specifically, when a doublet shown in Table 1 is used as a reflective mirror and a second surface of the double functions to reflect a dot reticle, a directional finite ray aberration of light rays, which are reflected from the reflective mirror and then incident on the observer's eye(s) in the state in which the dot reticle is positioned on the focal point of the reflective mirror, is about 0.14 milliradians as illustrated in FIG. 2A. In FIGS. 2A and 2B, an x axis represents the effective diameter of the reflective mirror, and a y axis represents a directional finite ray aberration.

TABLE 1

| | |
|---|---|
| Focal distance (f) | −27.2893 mm |
| Thickness ($t_1$) of first lens | $t_1$ = 2.00 mm |
| Curvature radius ($R_1$) of first surface | $R_1$ = −28.484 mm |
| Thickness ($t_2$) of second lens | $t_2$ = 2.50 mm |
| Curvature radius ($R_2$) of second surface | $R_2$ = −43.116 mm |
| Curvature radius ($R_3$) of third surface | $R_3$ = −30.014 mm |
| glass | BK7 |
| Effective diameter | Vertical size: 12.5 mm<br>Horizontal size: 25.0 mm |

In the dot sight device employing the reflective mirror shown in Table 1, when the position of the dot mask is changed from the state in which the dot reticle is positioned on the focal point of the reflective mirror for zeroing, for example, when 0.5 mm is changed downward, and 0.5 mm is changed rightward, the dot reticle deviates from the focal point of the reflective mirror. In this case, a directional finite ray aberration of light rays, which are reflected from the reflective mirror and then incident on the observer's eye(s), is about 1.21 milliradians as illustrated in FIG. 2B, and an parallax error of reflected light rays in the edge portion of the reflective mirror increases to be about 860 times as large as that of FIG. 2A.

BRIEF SUMMARY

In an embodiment, a dot sight includes a base, a housing, a reflective element, an emitter, a horizontal adjusting portion and a vertical adjusting portion. The housing is coupled to the base. The reflective element is coupled to the housing. The emitter provides a reticle image to the reflective element. The reflective element reflects at least a portion of the reticle image. The emitter is coupled to the housing. The horizontal adjusting portion adjusts a position of the housing relative to the base. The vertical adjusting portion adjusts a position of the housing relative to the base.

In another embodiment, a method of adjusting a dot sight includes: providing a base, a housing coupled to the base, a reflective element coupled to the housing, and an emitter that provides a reticle image to the reflective element, the reflective element reflecting at least a portion of the reticle image, and the emitter being coupled to the housing; and adjusting a position of the housing relative to the base while the reflective element and the emitter are fixed to the housing.

DETAILED DESCRIPTION

Figure 1:
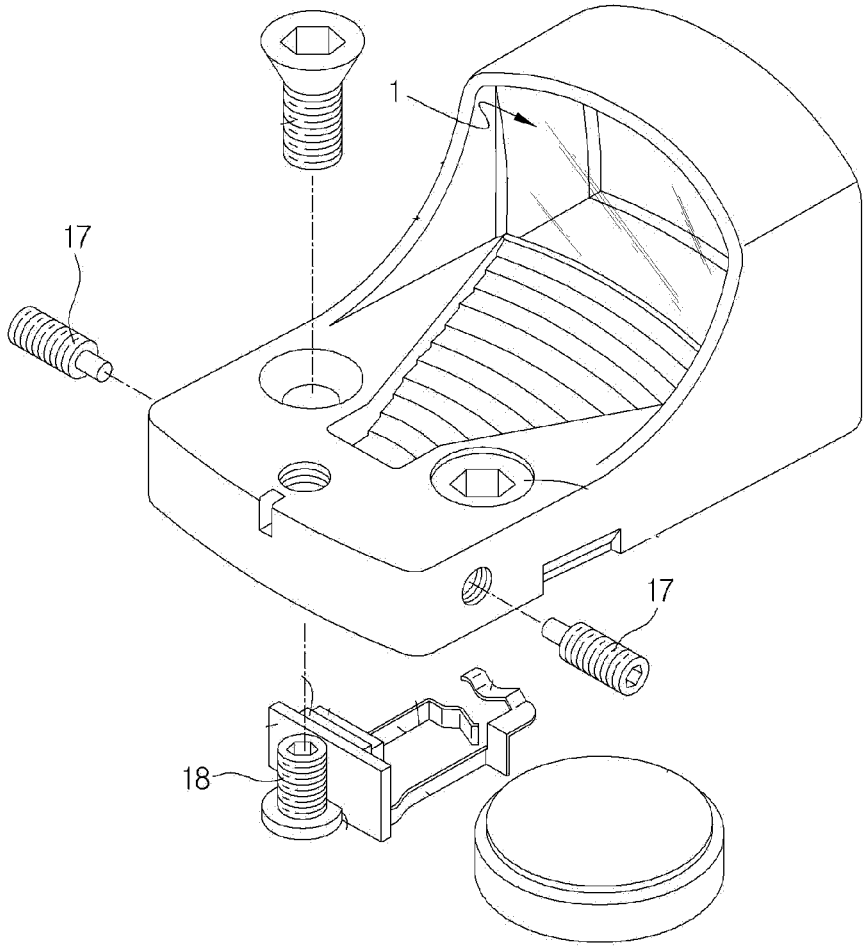
FIG. 1 is an exploded perspective view a dot sight device for used in a small arm according to a related art.

Hereinafter, exemplary embodiments of a dot sight device for used in a small arm according to the present disclosure will be described with reference to the appended drawings.

In an exemplary embodiment, a dot sight device is provided for use in a small arm which is capable of aligning a principal ray with a gun barrel of a small arm without causing a change in a relative position between an LED (that is, a mask) and a reflective mirror, that is, without causing a change in parallax of a dot sight device.

In an exemplary embodiment, a compact dot sight device is provided for use in a small arm which is capable of increasing an accuracy rate.

A dot sight device for used in a small arm according to a first embodiment of the present disclosure will be described below. First, the structure of the dot sight device for used in a small arm according to the first embodiment of the present disclosure will be described with reference to FIGS. 3 to 6.

A dot sight device 100 for used in a small arm according to the first embodiment of the present disclosure is mounted on the rear end of a slide of a small arm P in parallel with a gun barrel, and includes a base 110, a housing 120, a connecting member 130, an adjusting member 140, and an elastic member 150.

The base 110 is removably mounted on the slide of the small arm P or formed integrally with the slide of the small arm P, and includes a first accommodating groove 114 that accommodates the bottom portion of the housing 120.

The housing 120 includes a reflective mirror 123 arranged on one end facing a target, a dot reticle generating unit 124 that is arranged on the other end facing the observer and emits dot light toward the reflective mirror 123, and a cover 125 arranged to cover the reflective mirror 123. The dot reticle generating unit 124 includes an LED and a mask, and the mask is generally fixed to the front of the LED. Light emitted from the dot reticle generating unit 124 has a shape (for example, a dot, a spot, or a cross) corresponding to the shape of the mask. In the present embodiment, the mask is assumed to have the dot shape, and thus the light emitted from the dot reticle generating unit 124 is referred to as a dot reticle. However, the shape of the mask is not limited to the dot shape, and for example, the mask may have the cross shape. The cover 125 extends in the optical axis direction so that the reflective mirror 123 and the dot reticle generating unit 124 are arranged in space formed by the cover 125. A battery that supplies power to the dot reticle generating unit 124 is removably installed in the housing 120, and a power switch used to selectively supply battery power to the dot reticle generating unit 124 is arranged on one side of the housing 120. In the drawings, the cover 125 is formed separately from the housing 120 and assembled with the housing 120, but the cover 125 may be formed integrally with the housing 120.

The connecting member 130 includes a first coupling hole 111 that is vertically formed on one end of the base 110, a second coupling hole 121 that is vertical formed at the position corresponding to the first coupling hole 111 in one end of the housing 120, a hinge shaft 131 having a rear end which is supported by the second coupling hole 121 of the housing 120 and a front end which vertically pass through the second coupling hole 121 and is screw-coupled with the first coupling hole 111 of the base 110, and a ring-like elastic support 132 which is made of rubber providing elastic repulsive force again compressive force and interposed between the first coupling hole 111 of the base 110 and the second coupling hole 121 of the housing 120. Spherical surfaces are formed on upper inner circumferential surfaces of the head portion 131*a* of the hinge shaft 131 and the second coupling hole 121 supporting the head portion 131*a*. Through the hinge shaft 131, the housing 120 connected to one end of the base 110 can vertically or horizontally rotate or move on the spherical center of the head portion 131*a* and the second coupling hole 121 since the elastic support 132 is interposed between the first coupling hole 111 of the base 110 and the second coupling hole 121 of the housing 120.

The adjusting member 140 includes a first connecting portion 112, a second connecting portion 122, a joint 141, a horizontal adjusting portion 142, and a vertical adjusting portion 143. The first connecting portion 112 is formed on the other end of the base 110, and has a movement space 113 which is formed in a horizontally extending long hole shape in the center of the first connecting portion 112 in the vertical direction. The second connecting portion 122 is arranged on the other end of the housing 120 at the position of the movement space 113 of the first connecting portion 112. The joint 141 includes a horizontal coupling hole 141*a* which is formed in the horizontal direction and a vertical coupling hole 141*b* which is formed in the vertical direction, and is arranged in the movement space 113 of the base 110 to be movable in the horizontal direction. Here, an axis of the horizontal coupling hole 141*a* meets and crosses an axis of the vertical coupling hole 141*b* at the same plane. The horizontal adjusting portion 142 passes through the first connecting portion 112 of the base 110 and the joint 141 in a direction perpendicular to the gun barrel on a horizontal plane, is rotatably supported by the first connecting portion 112, and is screw-coupled with the horizontal coupling hole 141*a* of the joint 141. The vertical adjusting portion 143 passes through the second connecting portion 122 of the housing 120 and the joint 141 in a direction perpendicular to the gun barrel on a vertical plane, is rotatably supported by the second connecting portion 122, and is screw-coupled with the vertical coupling hole 141*b* of the joint 141. Here, since the joint 141 is configured such that an axis of the horizontal coupling hole 141*a* meets and crosses an axis of the vertical coupling hole 141*b* at the same plane, the vertical adjusting portion 143 preferably has the length by which the vertical adjusting portion 143 does not come into contact with the horizontal adjusting portion 142 even when the vertical adjusting portion 143 is completed fastened into the vertical coupling hole 141*b*.

The elastic member 150 includes a plate spring, is interposed between the first accommodating groove 114 of the base 110 and the bottom portion of the housing 120, and elastically supports the housing 120 in a direction in which the housing 120 gets away from the base 110.

The present embodiment has been described in connection with the example in which the hinge shaft 131 is inserted into the second coupling hole 121 from the top surface of the housing 120 and then screw-coupled with the first coupling hole 111 of the base 110. However, the hinge shaft 131 may be inserted into the first coupling hole 111 from the bottom surface of the housing 120 and then screw-coupled with the second coupling hole 121 of the housing 120. In this case, a spherical surface corresponding to the head portion 131*a* of the hinge shaft 131 is formed on a lower inner circumferential surface of the first coupling hole 111, and the second coupling hole 121 has a screw thread to be coupled with the hinge shaft 131.

Next, an operation of adjusting the dot sight device according to the first embodiment of the present disclosure will be described with reference to FIGS. 7 to 12.

Figure 7:
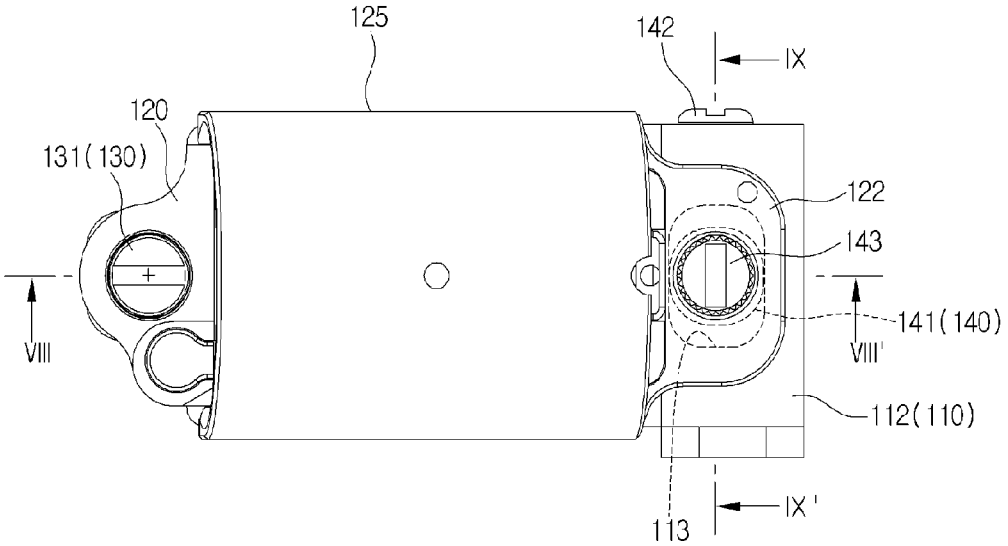
FIG. 7 is a top view illustrating the dot sight device according to the first embodiment of the present disclosure.
Figure 8:
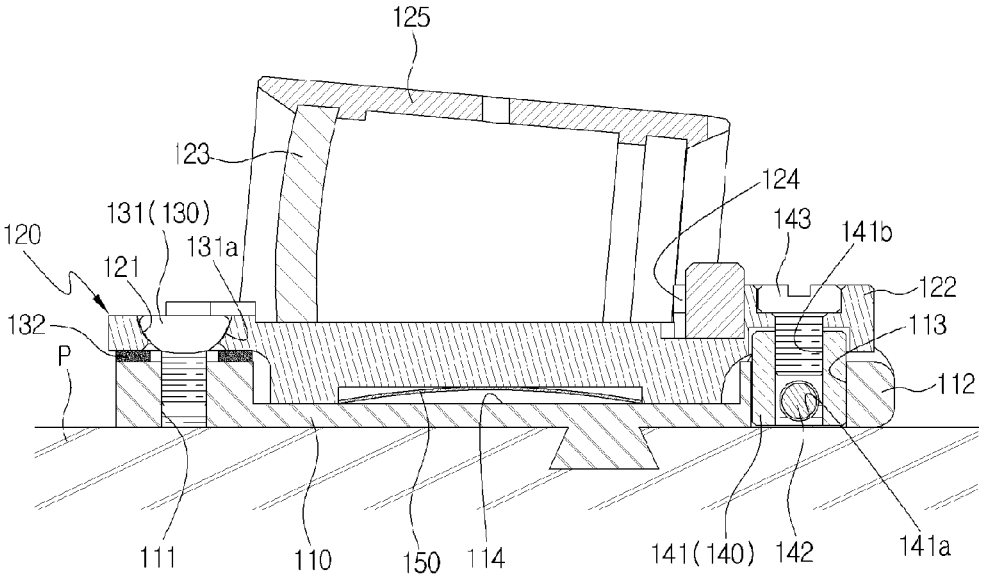
FIG. 8 is a cross-sectional view taken along line VIII-VIII' of FIG. 7.
Figure 9:
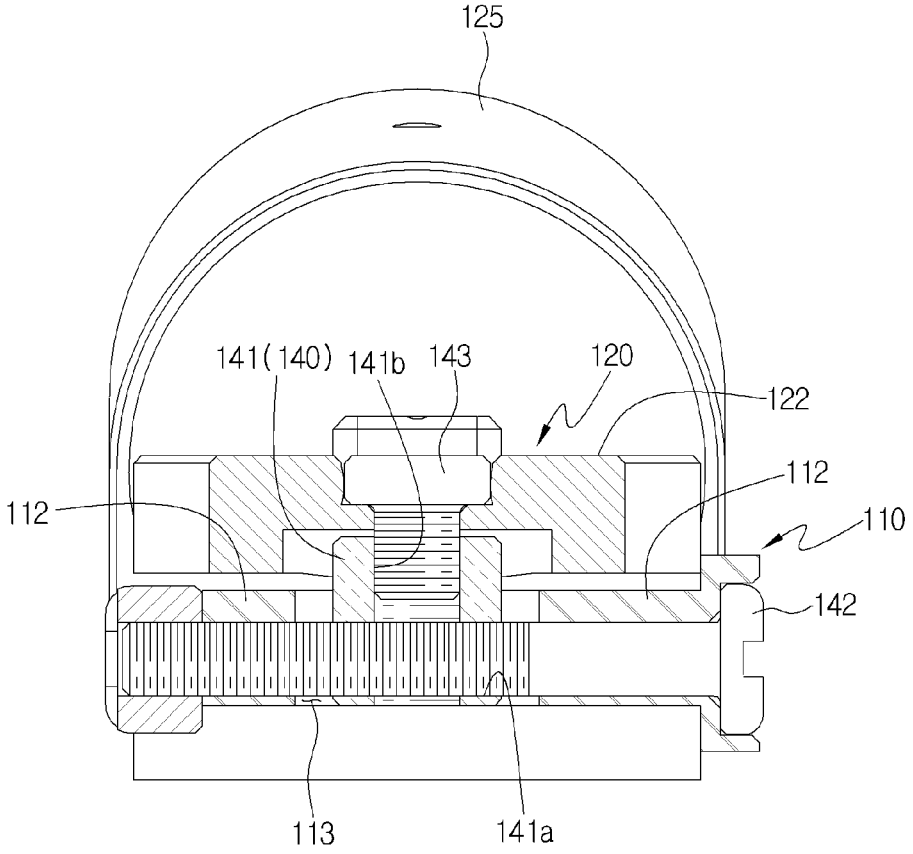
FIG. 9 is a cross-sectional view taken along line IX-IX' of FIG. 7.

Referring to FIGS. 7 to 9, the base 110 is mounted on the rear end of the slide of the small arm P in parallel with the gun barrel, and the bottom portion of the housing 120 is placed on the first accommodating groove 114 of the base 110 to overlap the base 110. One end of the housing 120 is coupled with the base 110 through the hinge shaft 131 of the connecting member 130, and the housing 120 is vertically or horizontally rotatable or movable from the base 110 centering on the hinge shaft 131.

More specifically, the hinge shaft 131 connects the housing 120 with the base 110 such that the upper end portion of the hinge shaft 131 is coupled with the first coupling hole 111 of the base 110 in the state in which the upper end portion of the hinge shaft 131 comes in close contact with the second coupling hole 121 of the housing 120. At this time, the spherical surface formed in the inner upper circumferential surface of the second coupling hole 121 comes into close contact with the spherical surface of the head portion 131*a* of the hinge shaft 131. Further, the elastic support 132 of the ring form through which the hinge shaft 131 passes is interposed between the first coupling hole 111 of the base 110 and the second coupling hole 121 of the housing 120, and so the base 110 is apart from the housing 120 by a predetermined distance. Through this structure, the housing 120 can rotate or move on the center of the spherical surface in the horizontal direction or the vertical direction in the state in which the spherical surface of the head portion 131*a* of the hinge shaft 131 comes into close contact with the spherical surface of the second coupling hole 121. Here, the elastic support 132 includes a ring-like member made of polyolefin, polypropylene, polyethylene, or rubber or a ring spring.

In the state in which the joint 141 of the adjusting member 140 is arranged between the second connecting portion 122 formed at the other end portion and the first connecting portion 112 of the base 110, the housing 120 is rotated or moved by the horizontal adjusting portion 142 that moves the horizontal adjusting portion 142 in the horizontal direction at the side of the base 110 and the vertical adjusting portion 143 that adjusts the interval between the joint 141 and the housing 120 in the vertical direction at the side of the housing 120.

The horizontal adjusting portion 142 is assembled such that the horizontal adjusting portion 142 of the shaft form passes through the first connecting portion 112 to cross the movement space 113, in which the joint 141 is arranged, in the horizontal direction in the state in which the joint 141 is arranged in the movement space 113 vertically formed in the center of the first connecting portion 112 of the base 110 and is movable in the movement space 113 in the horizontal direction. At this time, both ends of the horizontal adjusting portion 142 are rotatably supported by the first connecting portion 112, and the central portion of the horizontal adjusting portion 142 is screw-coupled with the horizontal coupling hole 141*a* which is formed in the joint 141 in the horizontal direction. Thus, as the horizontal adjusting portion 142 rotates in the forward direction or the reverse direction, the joint 141 screwed-coupled with the horizontal adjusting portion 142 through the horizontal coupling hole 141*a* moves in the horizontal direction along with the horizontal adjusting portion 142 crossing the movement space 113 in the horizontal direction, so that the position of the housing 120 in the horizontal direction, that is, the horizontal angle between the base 110 and the housing 120 is adjusted.

Further, the vertical adjusting portion 143 is assembled such that the vertical adjusting portion 143 of the shaft form vertically passes through the second connecting portion 122 arranged at the position corresponding to the movement space 113 of the base 110 at the other end portion of the housing 120 and then is screw-coupled with the vertical coupling hole 141*b* of the joint 141. The upper end portion of the vertical adjusting portion 143 is rotatably supported by the second connecting portion 122, and the housing 120 is elastically supported by the elastic member 150 interposed between the base 110 and the housing 120 in the direction (upward direction) in which the housing 120 gets apart from the base 110. Further, since the joint 141 is coupled with the base 110 side through the horizontal adjusting portion 142, force of constraint works in the vertical direction. Thus, as the vertical adjusting portion 143 rotates in the forward direction or the reverse direction, the lower end portion of the vertical adjusting portion 143 is fastened into or loosened from the vertical coupling hole 141*b* of the joint 141, and thus the position of the housing 120 in the vertical direction, that is, the vertical angle between the housing 120 and the base 110 is adjusted since the repulsive force of the elastic member 150 works upward.

In other words, the horizontal adjusting portion 142 rotatably supported at the base 110 side is screw-coupled with the joint 141 in the horizontal direction, and the vertical adjusting portion 143 rotatably supported at the housing 120 side is screw-coupled with the joint 141 in the vertical direction. Thus, since separate plates used for horizontal and vertical movements in the related art need not be arranged between the base 110 and the housing 120, the compact dot sight device can be implemented, and thus since the distance between the dot sight device and the gun barrel is minimized, the accuracy rate of the small arm P can be improved.

Figure 3:
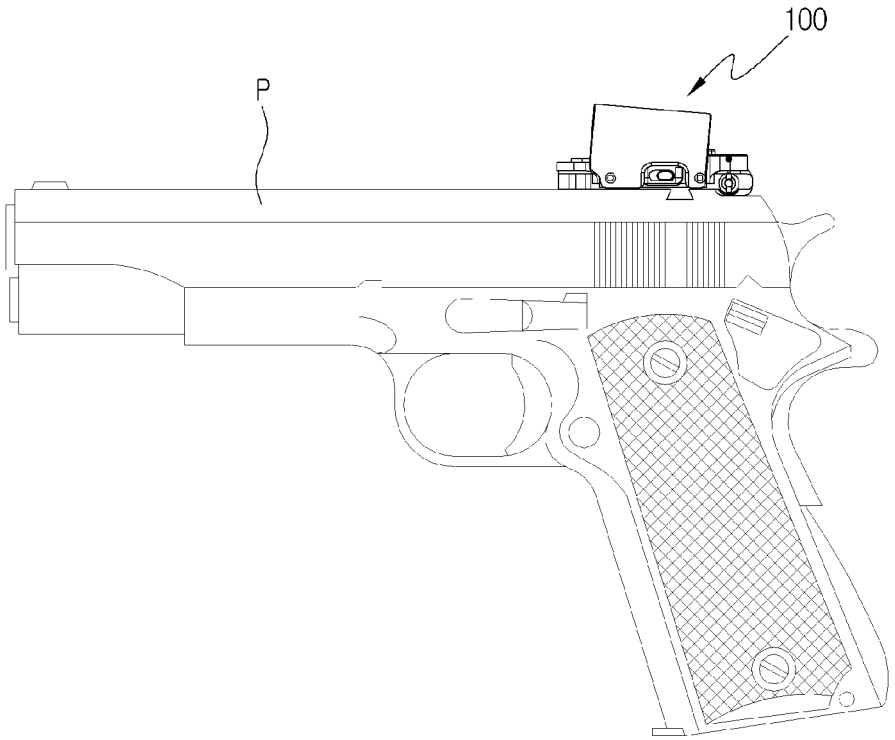
FIG. 3 is a diagram illustrating a dot sight device for used in a small arm according to the present disclosure.
Figure 4:
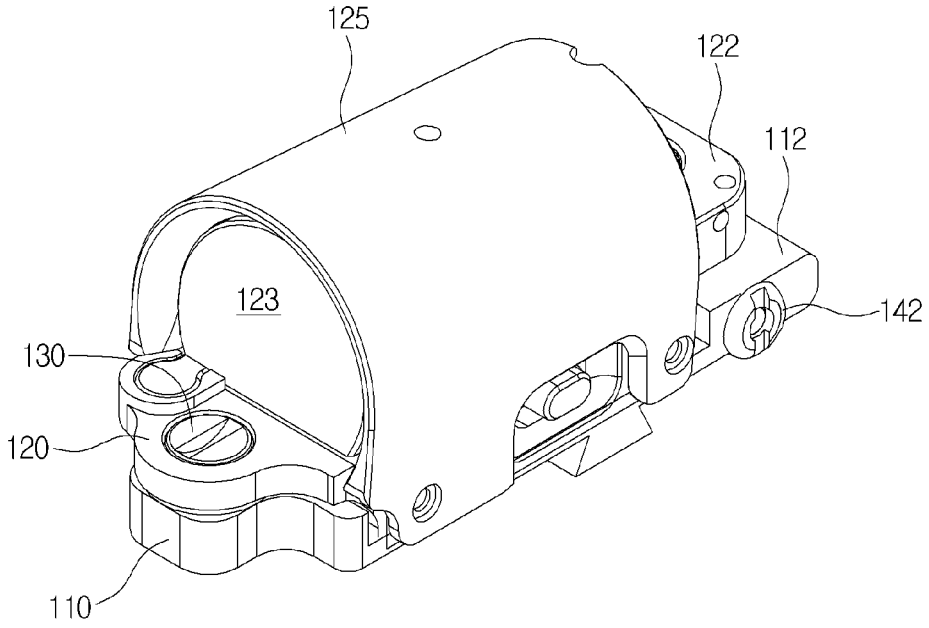
FIG. 4 is a perspective view illustrating a dot sight device for used in a small arm according to the first embodiment of the present disclosure.
Figure 5:
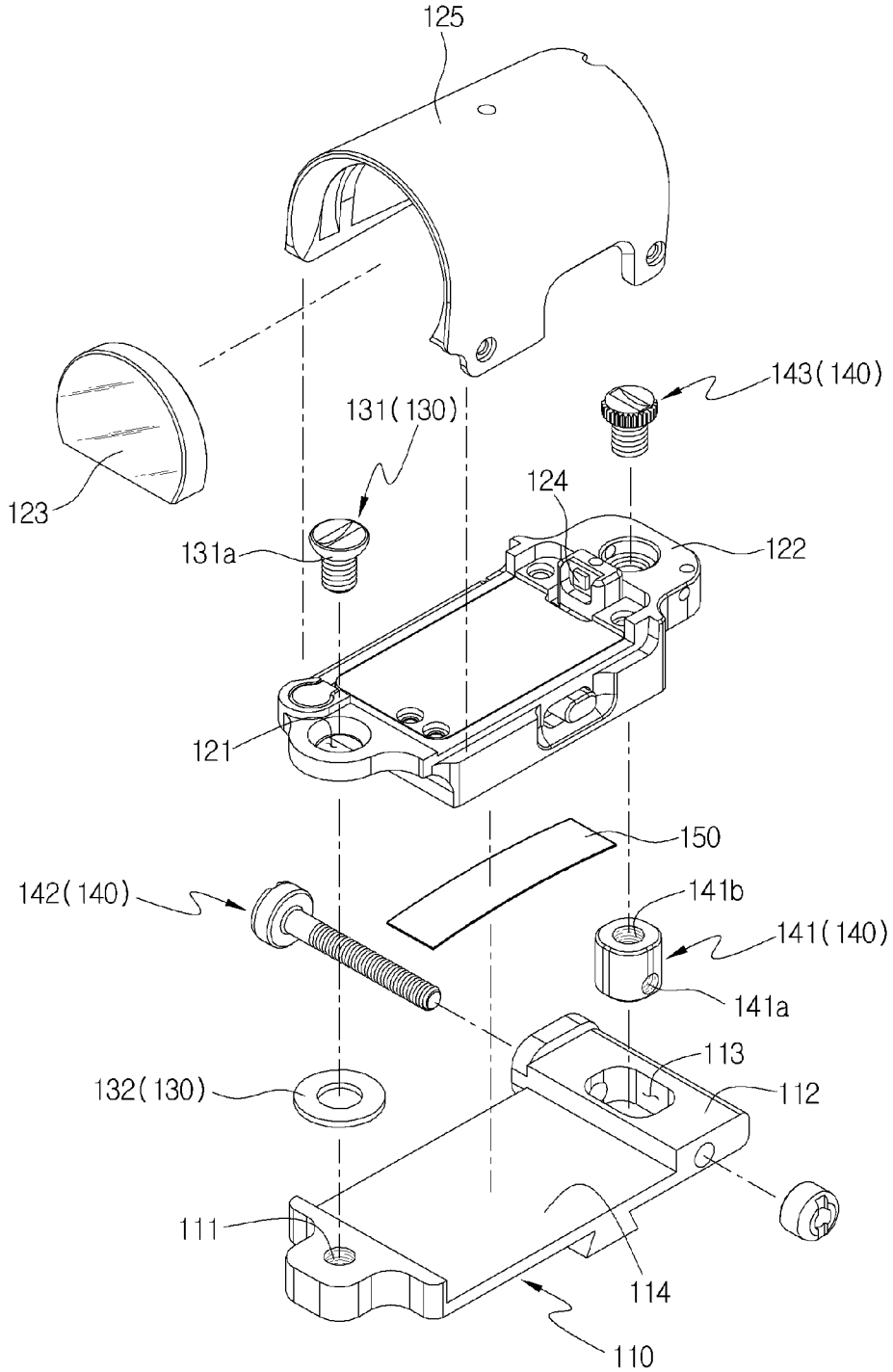
FIG. 5 is an exploded perspective view illustrating the dot sight device according to the first embodiment of the present disclosure.
Figure 6:
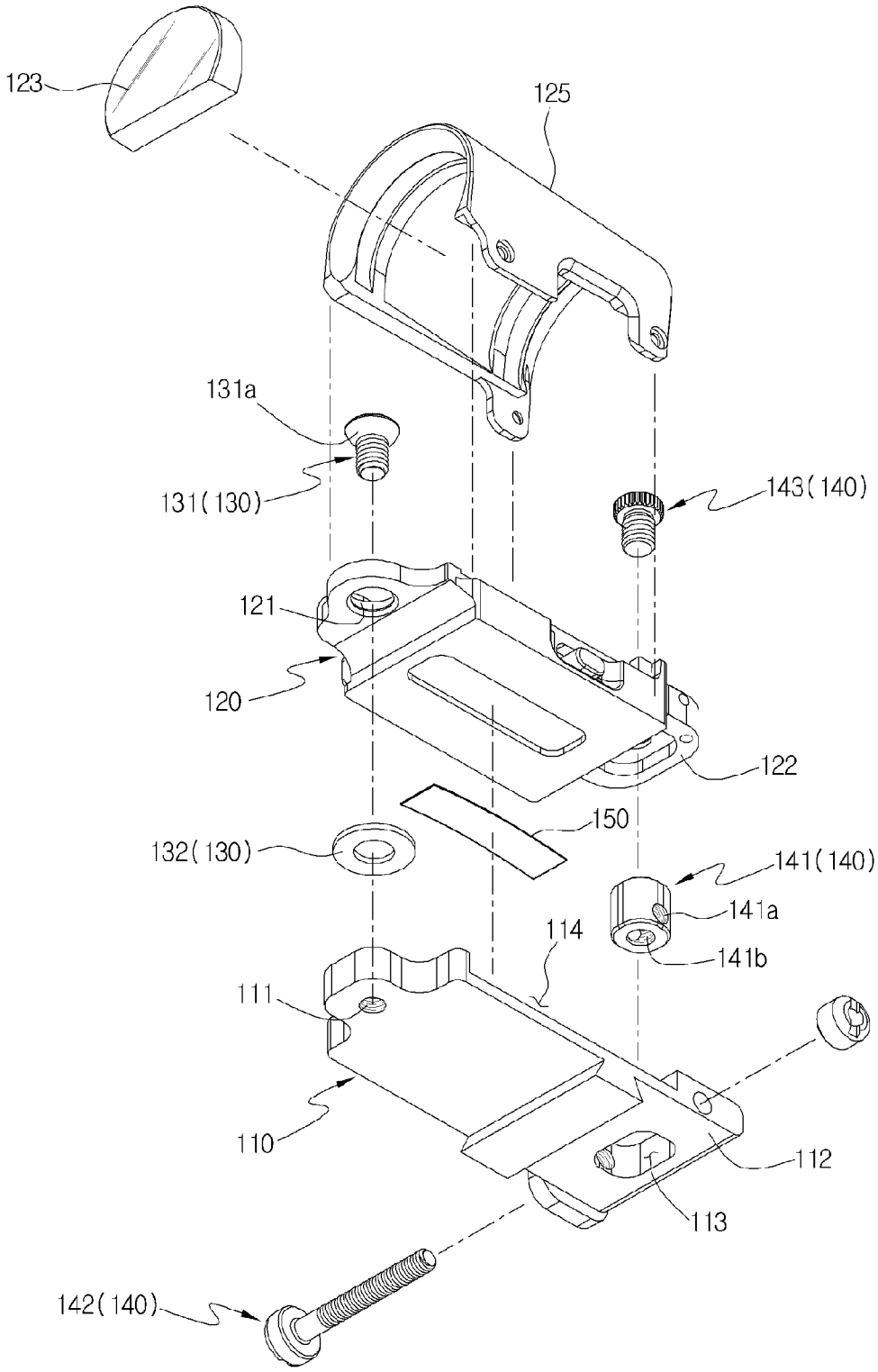
FIG. 6 is an exploded elevation view illustrating the dot sight device according to the first embodiment of the present disclosure.

In the assembled state as illustrated in FIG. 3, a dot reticle image generated such that the dot reticle emitted from the dot reticle generating unit 124 installed on the upper rear end portion of the housing 120 is reflected by the reflective mirror 123 is directed toward the observer's eye(s), and the observer shoots a gun in the state in which the dot reticle image is aligned with the target viewed through the reflective mirror 123.

At this time, when the dot reticle image is not aligned with an aiming point, that is, the target, the dot reticle image is not aligned with an aiming point, that is, the target by adjusting the horizontal angle and/or the vertical angle between the base 110 and the housing 120 using the horizontal adjusting portion 142 and/or the vertical adjusting portion 143.

Figure 10:
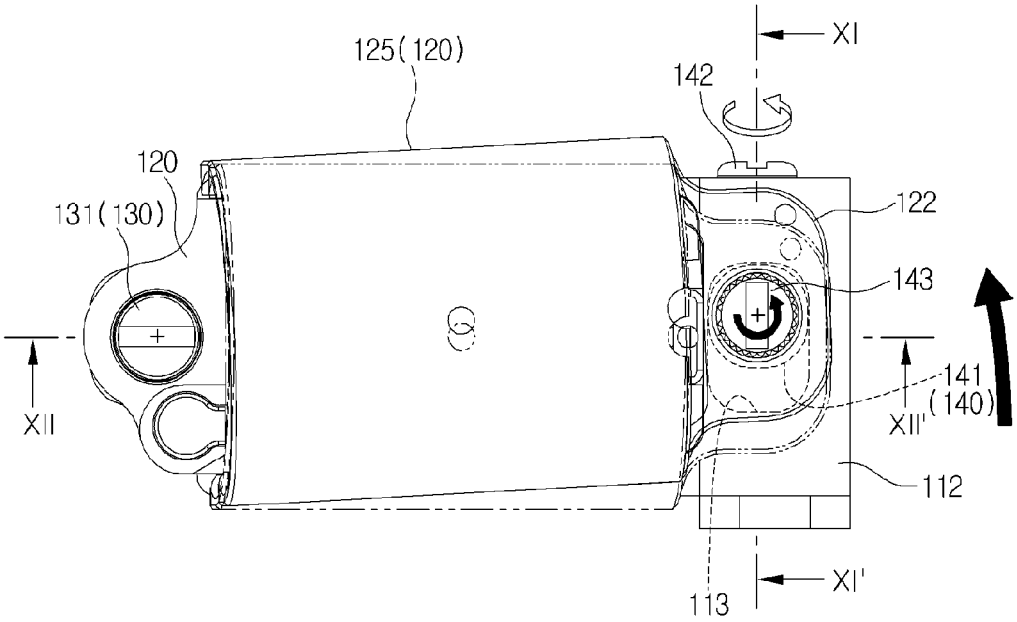
FIG. 10 is a top view for describing an operation of adjusting the dot sight device according to the first embodiment of the present disclosure.
Figure 11:
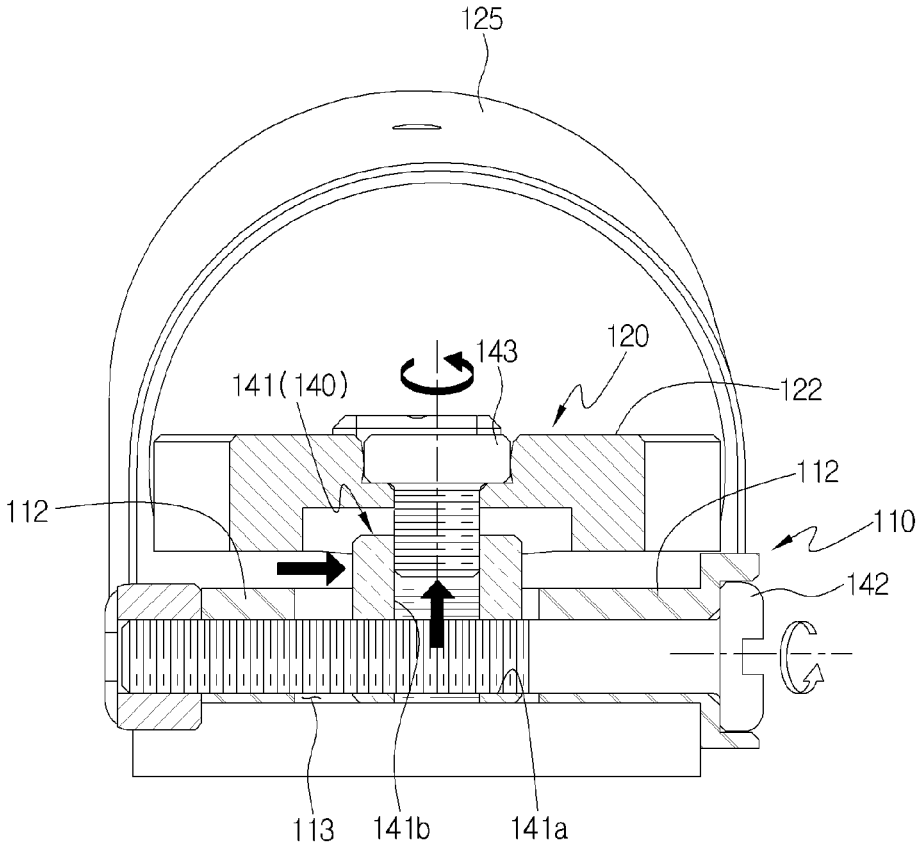
FIG. 11 is a cross-sectional view taken along line XI-XI' of FIG. 10.

First, an operation of adjusting the horizontal angle between the base 110 and the housing 120 will be described with reference to FIGS. 10 and 11.

When the horizontal adjusting portion 142 that passes through the first connecting portion 112 of the base 110 rotates in the horizontal direction, the horizontal adjusting portion 142 rotates above the base 110 since both ends of the horizontal adjusting portion 142 are supported by the first connecting portion 112. At this time, the joint 141 screw-coupled with the horizontal adjusting portion 142 through the horizontal coupling hole 141*a* moves left or right in the movement space 113 according to the rotating direction of the horizontal adjusting portion 142.

In other words, when the joint 141 coupled at the other end portion through the vertical adjusting portion 143 moves left or right along with the horizontal adjusting portion 142 in the state in which one end of the housing 120 is coupled to be rotatable with respect to the base 110 through the hinge shaft 131, the housing 120 rotates on the hinge shaft 131 in the left or right direction, and thus the horizontal angle of the housing 120 is adjusted.

Figure 12:
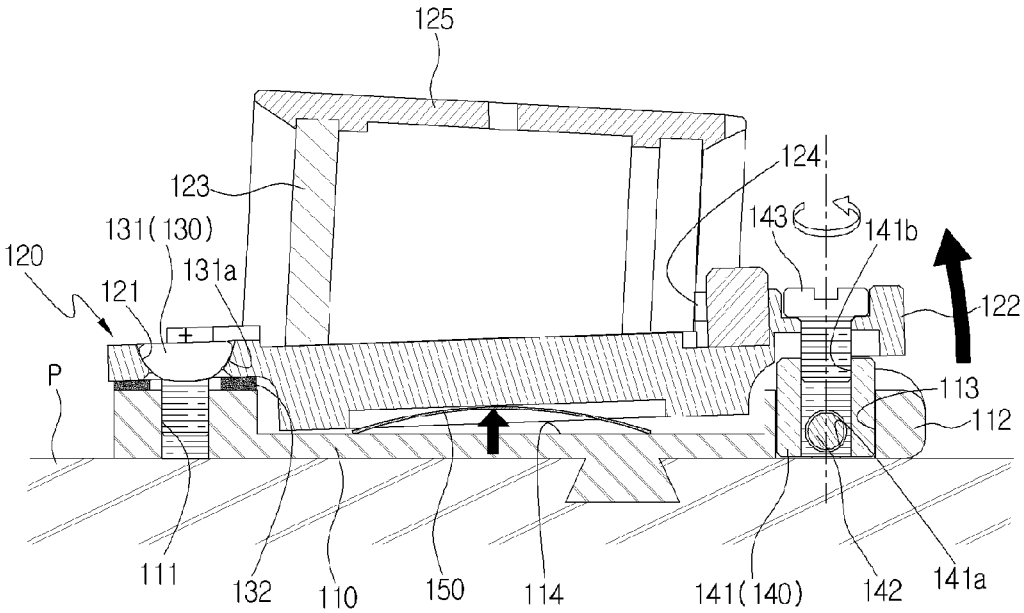
FIG. 12 is a cross-sectional view taken along line XII-XII' of FIG. 10.

Next, an operation of adjusting the vertical angle between the base 110 and the housing 120 will be described with reference to FIGS. 11 and 12.

The housing 120 is coupled with the joint 141 such that the vertical adjusting portion 143 that passes through the second connecting portion 122 arranged at the other end portion in the vertical direction is screw-coupled with the joint 141. At this time, the lower end portion of the vertical adjusting portion 143 is screw-coupled with the vertical coupling hole 141*b* of the joint 141 in the state in which the upper end portion of the vertical adjusting portion 143 is supported by the second connecting portion 122, and the elastic member 150 elastically supports the bottom portion of the housing 120 upward, that is, in the direction in which the housing 120 gets away from the base 110. Thus, the upper end portion of the vertical adjusting portion 143 constantly comes in close contact with the second connecting portion 122.

Further, since the joint 141 is coupled to the first connecting portion 112 of the base 110 through the horizontal adjusting portion 142 and movable only in the horizontal direction, force of constraint that limits movement in the vertical direction or rotation on the same axis line as the axis of the vertical adjusting portion 143 works on the base 110 side.

Thus, when the vertical adjusting portion 143 that passes through the second connecting portion 122 of the housing 120 in the vertical direction and is screw-coupled with the vertical coupling hole 141*b* of the joint 141 is rotated, the vertical adjusting portion 143 is fastened into or loosened from the vertical coupling hole 141*b* of the joint 141, and thus the vertical distance between the housing 120 and the joint 141 is adjusted.

At this time, as described above, the spherical surface formed on the second coupling hole 121 of the housing 120 comes in close contact with the spherical surface formed on the head portion 131*a* of the hinge shaft 131, and the elastic support 132 is arranged between the first coupling hole 111 and the second coupling hole 121, and so the distance between the base 110 and the housing 120 is elastically maintained. Thus, when the vertical adjusting portion 143 rotates in the forward direction or the reverse direction, the housing 120 in which the reflective mirror 123 and the dot reticle generating unit 124 are installed vertically rotates or moves on the center of the spherical surfaces of the second coupling hole 121 and the head portion 131*a*, and thus the vertical angle of the housing 120 is adjusted.

As described above, by rotating the horizontal adjusting portion 142 or the vertical adjusting portion 143 in the forward or reverse direction, the optical axis of the reflective mirror 123 arranged on the housing 120 can be adjusted with respect to the axis of the gun barrel in the horizontal or vertical direction, and thus it is possible to align an aiming point of the gun barrel with the position of the dot reticle image reflected by the reflective mirror 123. Particularly, since the rotational angle of the housing 120 is adjusted in the state in which the reflective mirror 123 and the dot reticle generating unit 124 are fixed to the housing 120, the relative position between the reflective mirror 123 and the dot reticle generating unit 124 does not change. Thus, a change in the relative position between the mask and the reflective mirror which causes a change in parallax of the dot sigh device is not caused. As a result, it is possible to prevent the dot reticle provided from the dot reticle generating unit 124 from deviating from the focal point of the reflective mirror 123 in the process of adjusting the dot reticle image with the aiming point, that is, the target.

Figure 2:
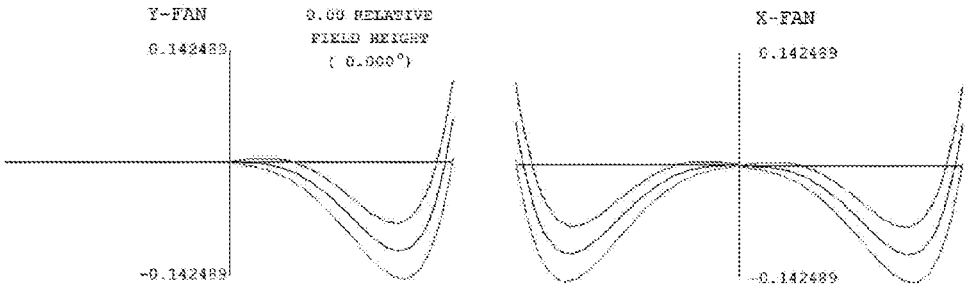
FIGS. 2A and 2B are graphs illustrating a directional finite ray aberration in a dot sight device for used in a small arm according to a related art.
Figure 2:
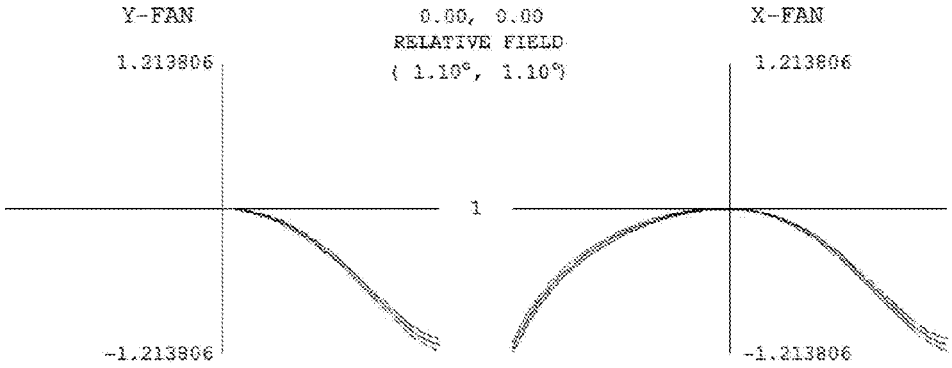

According to the present disclosure, zeroing (an adjustment of aligning the dot reticle image of the reflective mirror 123 with the aiming point of the gun barrel) is performed by adjusting the rotational angle of the housing 120 in the state in which the reflective mirror 123 and the dot reticle generating unit 124 are fixed to the housing 120, and thus since the dot reticle provided from the dot reticle generating unit 124 does not deviate from the focal point of the reflective mirror 123, a directional finite ray aberration of light rays which are reflected from the reflective mirror and then incident on the observer's eye(s) is maintained constantly as illustrated in FIG. 2A.

Next, a dot sight device for used in a small arm according to a second embodiment of the present disclosure will be described below with reference to FIGS. 13 to 16. In the second embodiment, the same components as in the first embodiment are denoted by the same reference numerals, and thus a detailed description thereof will be omitted.

Figure 13:
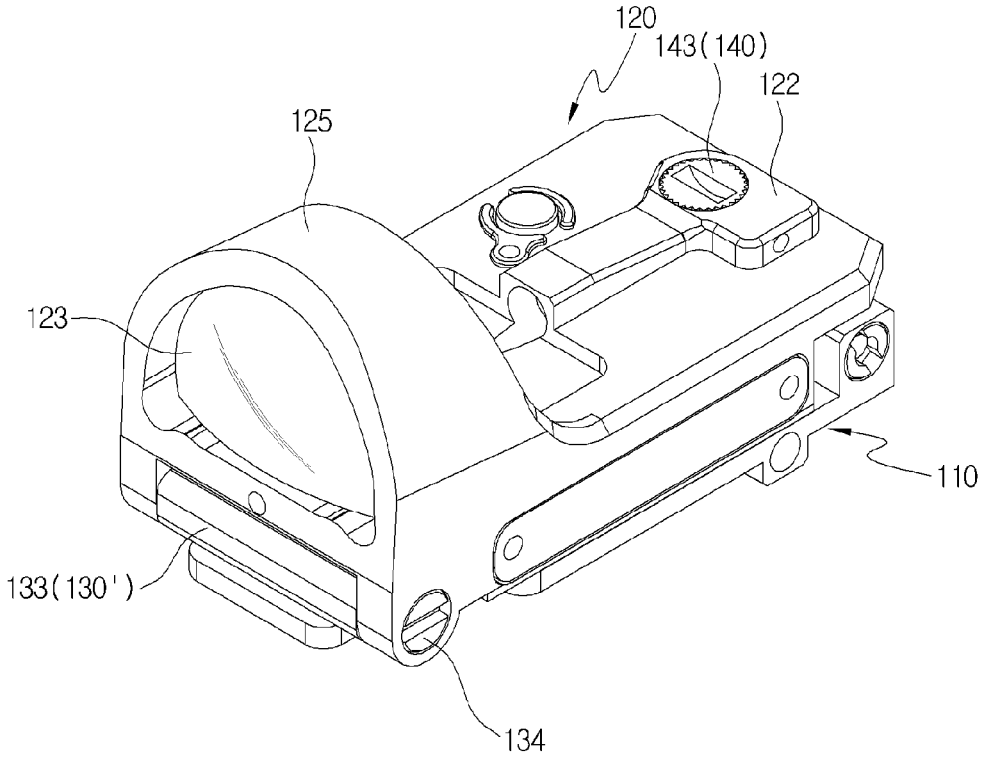
FIG. 13 is a perspective view illustrating a dot sight device for used in a small arm according to the second embodiment of the present disclosure.
Figure 14:
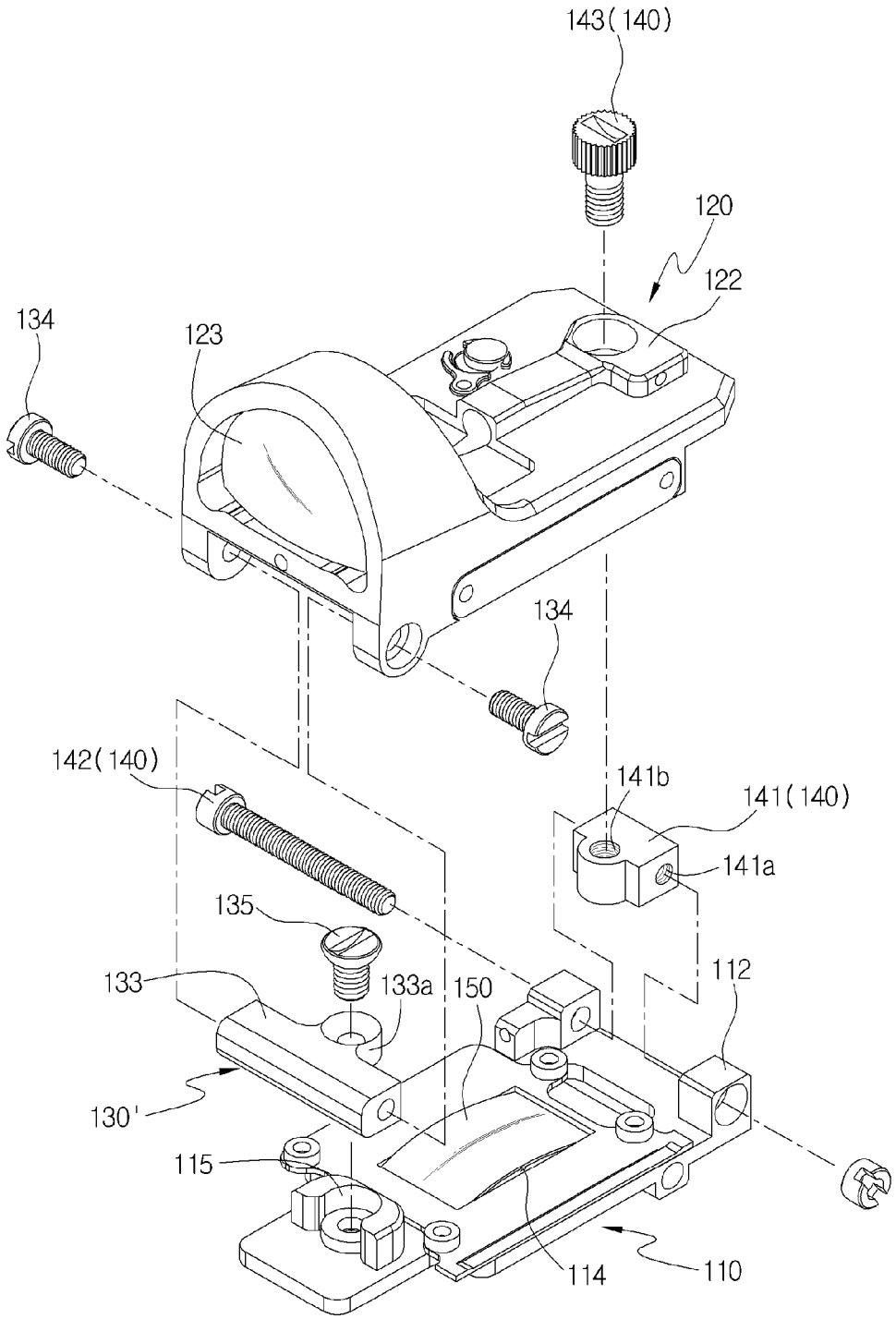
FIG. 14 is an exploded perspective view illustrating the dot sight device according to the second embodiment of the present disclosure.

First, referring to FIGS. 13 and 14, the dot sight device according to a second embodiment of the present disclosure is different from that according to the first embodiment in that a connecting member 130' that rotatably connects one end of the base 110 with one end of the housing 120 is provided instead of the connecting member 130.

The connecting member 130' includes a rotating member 133 arranged between one end of the base 110 and one end of the housing 120, a vertical connecting shaft 135 that passes through the rotating member 133 and is fixed to the base 110 so that the rotating member 133 and the housing 120 can rotate in the horizontal direction, and a horizontal connecting shaft 134 that passes through both ends of one end of the housing 120 and fixed to the rotating member 133 so that the rotating member 133 and the housing 120 can rotate in the vertical direction.

Further, a disc-like protrusion 133*a* is formed in the form of a letter "Ω" to protrude from one end of the rotating member 133, and the vertical connecting shaft 135 passes through the disc-like protrusion 133*a*. An arch-like guide 115 that guides the rotation of the rotating member 133 in the horizontal direction is formed on the base 110 to surround a part of the edge of the disc-like protrusion 133*a*.

Meanwhile, in the first embodiment, the axis of the horizontal coupling hole 141*a* intersects with the axis of the vertical coupling hole 141*b* on the same plane, but the joint 141 is configured such that the axis of the horizontal coupling hole 141*a* may not intersect with the axis of the vertical coupling hole 141*b* on the same plane as illustrated in 16. In other words, the horizontal coupling hole 141*a* and the vertical coupling hole 141*b* may be formed on different planes.

Figure 15:
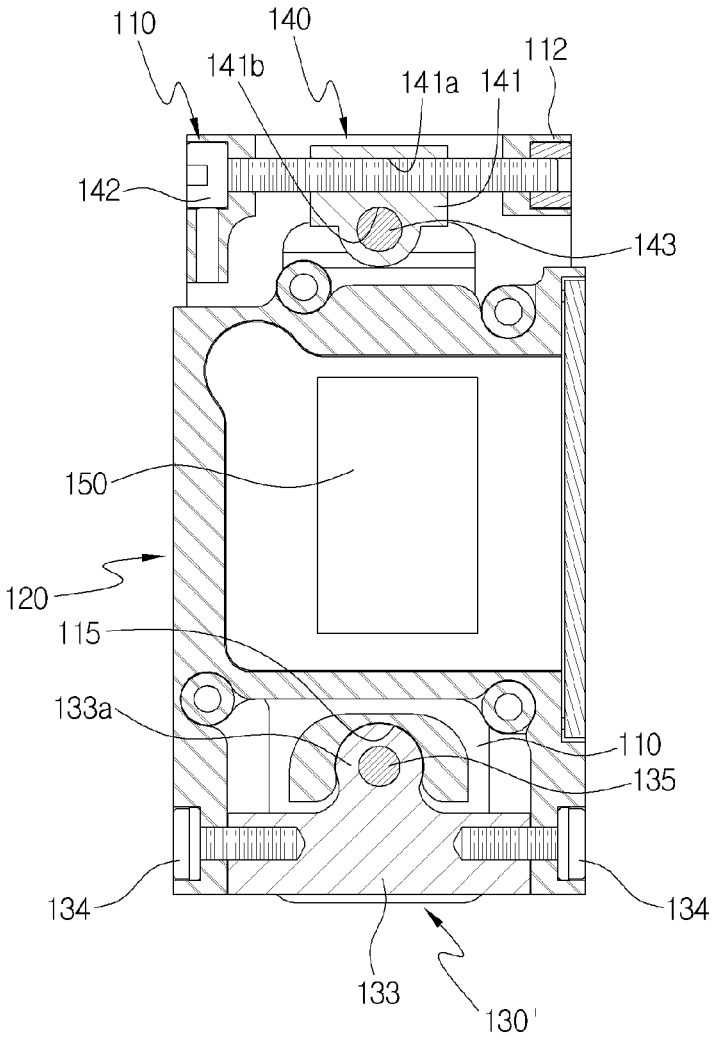
FIG. 15 is a plane view illustrating the dot sight device according to the second embodiment of the present disclosure.
Figure 16:
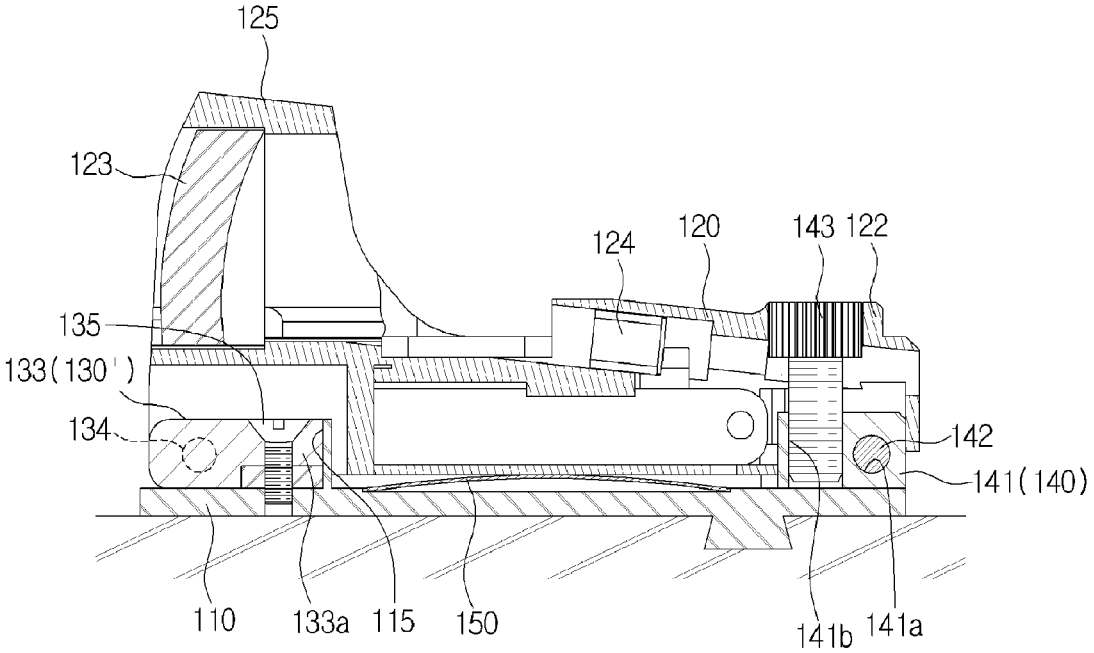
FIG. 16 is a cross-sectional view illustrating the dot sight device according to the second embodiment of the present disclosure.

The assembly and an operation of the connecting member 130' will be described with reference to FIGS. 15 and 16. The operations of the horizontal adjusting portion 142 and the vertical adjusting portion 143 are the same as described above in the first embodiment, and thus a description thereof will be omitted.

In the state in which the disc-like protrusion 133*a* formed to protrude from one end of the rotating member 133 is arranged on the base 110, the vertical connecting shaft 135 passes through the disc-like protrusion 133*a* in the vertical direction and is coupled with the base 110. Then, the horizontal connecting shaft 134 that passes through both ends of one end of the housing 120 is coupled with both ends of the other end portion of the rotating member 133.

In this state, when the horizontal adjusting portion 142 of the adjusting member 140 arranged at the other end of the base 110 is rotated in order to adjust the horizontal position of the other end portion of the housing 120, the rotating member 133 arranged to be rotatable or movable in the horizontal direction between the housing 120 and the base 110 rotates or moves on the vertical connecting shaft 135.

Further, when the vertical adjusting portion 143 of the adjusting member 140 is rotated in order to adjust the vertical position of the other end portion of the housing 120, the housing 120 rotates on the horizontal connecting shaft 134 in the vertical direction.

Meanwhile, the vertical connecting shaft 135 passes through the disc-like protrusion 133*a* of the rotating member 133 in the vertical direction and is then coupled with the base 110, and since the arch-like guide 115 surrounding the edge of the disc-like protrusion 133*a* is formed on the base 110, the assembly position of the base 110 and the rotating member 133 is guided, and it is possible to prevent shock caused by shooting from being concentrated on the vertical connecting shaft 135.

Meanwhile, for example, a bush functioning to minimize friction between the base 110 and the disc-like protrusion 133*a* may be arranged between the disc-like protrusion 133*a* and the base 110 for smooth rotation of the rotating member 133.

According to the embodiments of the present disclosure, it is possible to provide a dot sight device for use in a small arm which is capable of aligning a principal ray with a gun barrel of a small arm without causing a change in a relative position between a dot mask and a reflective mirror, that is, without causing a change in parallax of a dot sight device.

Further, it is possible to provide a compact dot sight device for use in a small arm which is capable of increasing an accuracy rate of a small arm.

While preferred embodiments have been described and illustrated above, it should be understood that these have been presented by way of example only, and are not limiting. Additions, omissions, substitutions, and other modifications can be made without departing from the spirit or scope of the present invention. Furthermore, the above advantages and features are provided in described embodiments, but shall not limit the application of such issued claims to processes and structures accomplishing any or all of the above advantages. Accordingly, the invention is not to be considered as being limited by the foregoing description, and is only limited by the scope of the appended claims and their equivalents.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A dot sight, comprising:
a base having a space defined therein;
a joint disposed in the space of the base;
a housing coupled to the base;
a reflective element coupled to the housing;
an emitter that provides a reticle image to the reflective element, the reflective element reflecting at least a portion of the reticle image, and the emitter being coupled to the housing;
a horizontal adjusting portion that adjusts a position of the housing relative to the base by moving the joint in the space; and
a vertical adjusting portion that adjusts a position of the housing relative to the base.

2. The dot sight of claim 1, wherein the reflective element is fixed to the housing and the horizontal adjusting portion adjusts a position of the reflective element and the housing together.

3. The dot sight of claim 1, wherein the emitter is fixed to the housing and the vertical adjusting portion adjusts a position of the emitter and the housing together.

4. The dot sight of claim 1, wherein the horizontal adjusting portion and the vertical adjusting portion include the joint.

5. The dot sight of claim 4, wherein the horizontal adjusting portion includes a first aperture defined in the joint.

6. The dot sight of claim 5, wherein the vertical adjusting portion includes a second aperture defined in the joint.

7. A dot sight, comprising:
a base:
a housing coupled to the base;
a reflective element coupled to the housing;
an emitter that provides a reticle image to the reflective element, the reflective element reflecting at least a portion of the reticle image, and the emitter being coupled to the housing;
a horizontal adjusting portion that adjusts a position of the housing relative to the base; and
a vertical adjusting portion that adjusts a position of the housing relative to the base, wherein
the horizontal adjusting portion and the vertical adjusting portion include a joint,
the horizontal adjusting portion includes a first aperture defined in the joint,
the vertical adjusting portion includes a second aperture defined in the joint, and
the first and second apertures intersect.

8. The dot sight of claim 6, wherein the first and second apertures are on different planes.

9. The dot sight of claim 6, wherein the horizontal adjusting portion includes a first screw, and the joint is a carrier that travels on the first screw.

10. The dot sight of claim 9, wherein the vertical adjusting portion includes a second screw, and the carrier travels on the second screw.

11. The dot sight of claim 1, further comprising an elastic member disposed between the housing and the base.

12. The dot sight of claim 1, further comprising a connecting member that couples the housing to the base.

13. A dot sight, comprising:

a base:

a housing coupled to the base;

a reflective element coupled to the housing;

an emitter that provides a reticle image to the reflective element, the reflective element reflecting at least a portion of the reticle image, and the emitter being coupled to the housing;

a horizontal adjusting portion that adjusts a position of the housing relative to the base;

a vertical adjusting portion that adjusts a position of the housing relative to the base; and a connecting member that couples the housing to the base, wherein the connecting member is disposed at a first side of the dot sight, and the horizontal adjusting portion and the vertical adjusting portion are disposed at a second side of the dot sight.

14. The dot sight of claim 13, wherein the connecting member includes an elastic support disposed between the housing and the base.

15. The dot sight of claim 13, wherein the housing pivots about the connecting member when the horizontal adjusting portion or the vertical adjusting portion are adjusted.

16. A method of adjusting a dot sight, comprising:

providing a base having a space defined therein, a joint disposed in the space of the base, a housing coupled to the base, a reflective element coupled to the housing, and an emitter that provides a reticle image to the reflective element, the reflective element reflecting at least a portion of the reticle image, and the emitter being coupled to the housing; and adjusting a position of the housing relative to the base by moving the joint in the space while the reflective element and the emitter are fixed to the housing.

17. The method of claim 16, wherein the adjusting includes adjusting a horizontal position of the housing relative to the base.

18. The method of claim 16, wherein the adjusting includes adjusting a vertical position of the housing relative to the base.

19. The method of claim 16, wherein the base and the housing are coupled by a horizontal adjusting portion and a vertical adjusting portion, the horizontal adjusting portion and the vertical adjusting portion include the joint, the horizontal adjusting portion includes a first aperture defined in the joint, and the vertical adjusting portion includes a second aperture defined in the joint.

20. A method of adjusting a dot sight, comprising:

providing a base, a housing coupled to the base, a reflective element coupled to the housing, and an emitter that provides a reticle image to the reflective element, the reflective element reflecting at least a portion of the reticle image, and the emitter being coupled to the housing; and adjusting a position of the housing relative to the base while the reflective element and the emitter are fixed to the housing, wherein the first and second apertures intersect.

* * * * *